United States Patent [19]

Gallic

[11] 4,294,450

[45] Oct. 13, 1981

[54] GOLF TRAINING AID AND GAME

[76] Inventor: John Gallic, 151 Lenape La., Berkeley Heights, N.J. 07922

[21] Appl. No.: 146,336

[22] Filed: May 2, 1980

[51] Int. Cl.[3] ..... A63B 69/36

[52] U.S. Cl. ..... 273/176 F; 273/178 A; 273/176 J

[58] Field of Search ..... 273/177 R, 177 A, 177 B, 273/178 R, 178 A, 178 B, 176 F

[56] References Cited

U.S. PATENT DOCUMENTS 1,229,766 6/1917 Long ..... 273/178 A 3,995,079 11/1976 Haas ..... 273/195 A X

*Primary Examiner*—George J. Marlo

*Attorney, Agent, or Firm*—Darby & Darby

[57] ABSTRACT

Disclosed herein is a golf putting game comprising a flexible base layer of predetermined length, a plurality of smooth monofilament ribbons locked into the base layer from the back and protruding onto the front face thereof to form a surface simulating a putting green, the ribbons extending for a predetermined essentially uniform first height above the base layer and being resilient, a supplemental backing layer bonded to said base layer and having a high coefficient of friction, a group of fibers having a substantially lower resiliency than the ribbons are anchored in the backing layer and extend through it and the base layer to an essentially uniform second height above the base. The second group of fibers is arrayed in a circular configuration to form a raised ring having the same interior diameter as a golf cup on the putting surface.

12 Claims, 3 Drawing Figures

GOLF TRAINING AID AND GAME

The present invention pertains to a golf practice game and training aid. More particularly, the invention relates to an apparatus which may be employed to improve a golfer's putting skill.

Training aids to be used in the improvement of a golfer's putting game have been available for many years. Such devices generally consist of a metallic ring designed to be placed, face up, on a floor or carpet surface. The golfer places a golf ball a fixed distance away, and using a putter, attempts to stroke the ball into the ring. To obtain a non-skid surface on which the ball will not roll, it is necessary to locate the metal ring on a carpet surface. Not all carpet surfaces have the same general characteristics (i.e., resiliency, uniform surface height, resistance to movement, etc.) as the green of a golf course. Furthermore, the surface characteristics of a rug or carpet will vary depending on the fiber, nap, age of the surface, wear, etc. Since the metal ring can be placed at different locations (i.e., on a carpet, floor, tile surface, etc.), it is not always possible to insure that the same surface conditions will be encountered from one location to another. Thus, if the metal ring is laid down on a shag carpet, the putting conditions will be different than those encountered on a low pile rug, or an uncarpeted floor. These factors make a carpet an undesireable practice putting surface, as the surface conditions may vary from point to point and do not simulate the surface of a putting green.

Also, a certain additional amount of force must be applied to the golf ball in order to drive it over the edge of the metal ring. Application of this additional energy to the ball on a golf green might result in driving it beyond the cup. Thus, the metal ring practice arrangement is unsatisfactory as a training aid, or even as a putting game, since it does not simulate the actual putting conditions that are encountered on a golf course.

It is an object of the present invention to provide an improved golf putting game and training aid.

A further object of the present invention is to provide a golf training aid which simulates the putting conditions actually encountered on a golf course.

A further object of the present invention is to provide a golf putting device having a uniform surface simulating the surface of the green on a golf course.

A still further object of the present invention is to provide a flexible golf practice putting green apparatus including one or more simulated cups (or holes) which is portable and may be transported about by the player.

Figure 1:
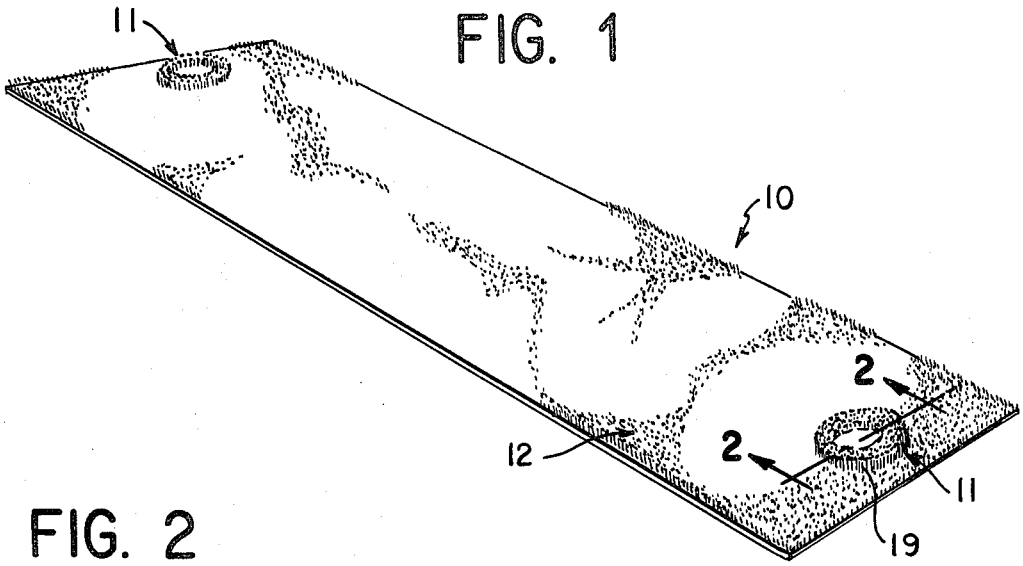

These and other objects of the present invention will be described with reference to the accompanying drawings wherein FIG. 1 represents a perspective view of the practice golf putting device of the present invention.

Figure 2:
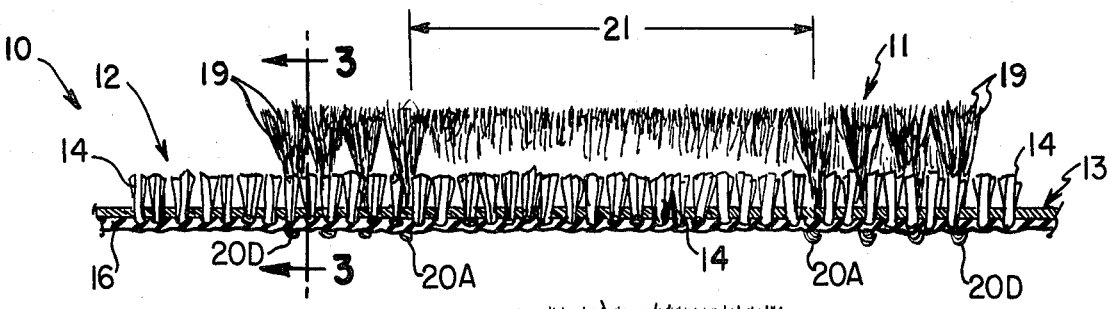
Figure 3:
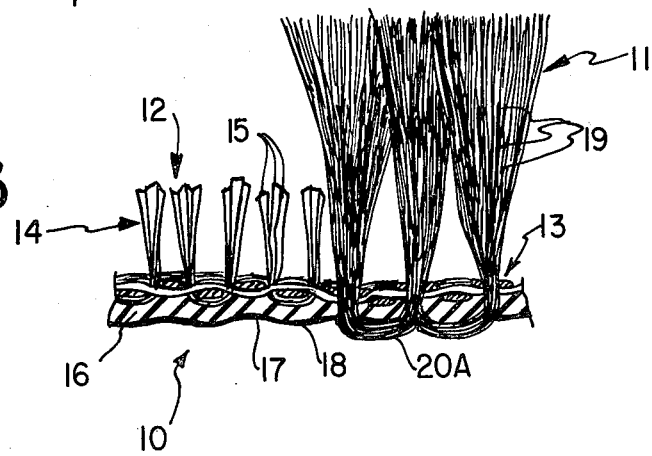

FIG. 2 is a cross-section of the golf putting device taken along the line 2—2 of FIG. 1; and FIG. 3 is an enlarged cross-sectional view along the line 3—3 of FIG. 2, in magnified form, illustrating the construction of the present invention.

In FIG. 1, reference number 10 indicates generally a preferred arrangement of the golf practice aid of the present invention. The device 10 is generally rectangular in shape and has a raised ring 11 simulating a golf hole or cup at each end. The surface 12 of the game device consists of a plurality of smooth fibers preferably in ribbon form that are anchored in a base 13. The anchored fibers 14 are made of a synthetic material that has resilient properties. By resilient properties is meant that a fiber or ribbon composed of such material can be compressed or crushed, and, on release of pressure, will tend to return to its original shape. Suitable resilient materials are man made ribbon like fibers formed from polymer materials with fibers made from olefin materials being nylon, polyesters, acrylics, modacrylics and polypropylenes.

The preferred material for use in making the putting surface is a monofilament ribbon of polypropylene, a low conductor of heat and generally the lightest in weight of the synthetic textile fibers. Preferably, the polypropylene ribbons 14 are extruded in flat, monofilament ribbons.

The raised rings 11 at each end of surface 12 are also formed of textile fibers. However, the fibers used to form rings 11 are substantially less resilient and longer than those employed in forming the putting surface 12.

Referring to FIG. 2, the construction details of golf practice device 10 are revealed in greater detail. The fiber ribbons 14 forming the putting surface 12 are anchored in a base material 13. The backing 13 is preferably a closely woven construction. Although the particular technique employed to anchor fibers 14 in backing 13 is not critical, it is preferable from the standpoint of wear and durability for the fibers to pass through backing 13.

Monofilament ribbons 14 are drawn or punched through the woven base 13 to form a pile fabric. The pile is sheared at a predetermined height to provide a uniform resilient surface closely simulating the putting surface of a golf course. The finished pile consists of a plurality of tufts 15 with each tuft consisting of a plurality of essentially uniform resilient, smooth fibers 14.

A continuous wear layer 16 of a relatively heavy backing material (e.g., rubber) is bound to the reverse face of the base 13 and facing away from the pile. The wear layer 16 covers the portions of the fibers 14 resting beneath the surface of base 13 and prevents them from being dislodged or pulled out of the woven base material.

Aside from its reinforcing function, wear layer 16 also serves as a friction layer to prevent inadvertent movement of the putting surface 12 while in use. To this end, the wear layer 16 is formed with an uneven surface. In a preferred embodiment of the invention, the surface of wear layer 16 has a waffle construction with high 17 and low 18 areas. Fiber tufts 15 protrude above the base layer 13 to a predetermined height. Preferably, this height is on the order of between $\frac{1}{8}$ to about $\frac{1}{2}$ inch.

Each raised ring 11 is formed of long multi-filament fibers. Fibers 19 are made of a material which is substantially less resilient than ribbons 14. Referring to FIG. 2, it will be seen that fibers 19 are substantially longer than ribbons 14 and are grouped or tufted around wear layer 16 and through base 13 to protrude above tufts 15. Because they are between 2 and 4 times the length of ribbons 14, fibers 19 protrude a substantially greater distance above the surface of base material 13. Fibers 19 are formed of materials that are generally less resilient than the compositions employed to form surface fibers 14. Nylon is a preferred composition for the fibers 19, although other low resilience fibers, of natural and synthetic origin including cotton, acrylics, modacrylics and saran, may be employed to form them. The fibers 19 are anchored in wear layer 16 and the woven ground fabric (base) 13 by a tufting procedure. The base or ground fabric 13 is composed of closely woven fibers. Pile loops are inserted through the wear layer 16 and base 13 with needles and the pile loops cut at a predetermined height on the surface. The multifilament tufts are held in place by untwisting of the tufted yarns 19 and the shrinkage of wear layer 16 and base 13 around the yarns 19.

Multifilament fibers 19 protrude above the surface of base 13 a distance of between about $\frac{1}{4}$ to about 2 inches. The exact extent to which a particular fiber protrudes is determined by its resilience and flexibility. The preferred nylon multifilament fibers protrude one inch above the surface of the fibers 14 of which the putting surface 12 is formed.

The fibers 19 are tufted to form a plurality of concentric rings (20A through 20D). The diameter 21 of the inner most ring (20A) is equal to the interior diameter of raised ring 11. This diameter 21 is identical to the interior diameter of a golf cup or hole ($4\frac{1}{4}$ inches).

In a preferred embodiment of the invention (as illustrated in FIG. 1), a pair of raised rings 11 are located in direct alignment with one another, at opposite ends or putting surface 12.

The apparatus 10 can be used desireably as a practice putting green. In use, the player places a standard golf ball at some point on putting surface 12 and using a conventional golf putter (not shown) tries to stroke the ball into the interior 21 of one of the raised rings 11. The rolling resistance of a standard USGA golf ball on putting surface 12 is approximately equal to the rolling resistance that would be encountered on the closely cropped grass used on the green of a golf course. Fibers 19 used to form the cup have relatively low resistance and do not unduly impede the passage of the golf ball into the diameter of the raised ring 11. However, because of their increased length, multifilament composition and relatively low resilience characteristics, yarns 19 do impart some resistance to passage of the ball from within the raised ring 11. This resistance to passage simulates the loss of rolling momentum encountered when a golf ball struck with the proper velocity falls into a golf cup.

The practice device 10 can also be used by one or more players in a game of putting skill. The game is played by placing a conventional golf ball in the raised ring 11 at one end of the putting surface. The object of the game is for a player, using a golf putting club, to move the ball with a single stroke of the club from the ring 11 in which it is resting to the center of the mating ring 11 at the opposite end of the green. By playing the game, participants improve the accuracy of their putting game.

The putting surface 12 may be made in any shape, or configuration, but is preferably in a rectangular configuration of approximately 7 feet long and 24 inches wide. Because the putting surface 12, base 13 and wear layer 16 are all made of flexible materials, the practice device 10 may be rolled up into a tube shape. Thus, it is a simple matter for a player to roll up the lightweight game apparatus 10 and transport it from one location to another. The game can be rolled out in any location. In this manner, it is possible for a player to practice his putting game on the same uniform surface in different locations. This eliminates the drawback of prior art arrangements which made it difficult to obtain repeatable surface conditions (e.g., rolling resistance) in subsequent practice sessions.

What is claimed is:

1. A practice putting game comprising a flexible base layer of predetermined length, a plurality of smooth monofilament fibers locked into said base from the back and protruding through the front surface thereof to form a simulated golf green surface, said fibers having a predetermined essentially uniform first height above said base, a continuous wear layer comprising a material having a high coefficient of friction covering the back of said base, a group of upright fibers anchored in said wear layer and protruding from said base through said monofilament fibers to a substantially uniform second height above said first height, said group of upright fibers being arrayed in a circle to define a raised ring, said ring having a predetermined interior diameter on the surface of said green, and said upright fibers being substantially less resilient than said monofilament fibers to permit a ball rolling on said monofilament fibers to pass through the circle of said upright fibers and into the interior of said ring.

2. The practice putting game according to claim 1 wherein said monofilament fibers comprise an olefin composition.

3. The practice putting game of claim 2 wherein said monofilament fibers comprise smooth polypropylene ribbons.

4. The practice putting game of claim 3 wherein said polypropylene ribbons protrude about $\frac{1}{2}$ inch above the surface of said base layer.

5. The practice putting game of claim 4 wherein said upright group of fibers comprises a plurality of multifilament yarns.

6. The practice putting game of claim 5 wherein said wear layer is formed of rubber.

7. The practice putting game according to claim 6 comprising two raised rings located at spaced apart points on said green surface, the centers of said rings being in alignment with each other.

8. The practice putting game according to claim 7 wherein said golf green surface is a sheared pile fabric formed of a plurality of tufted monofilament ribbons anchored in said base layer and held in said base layer by said wear layer.

9. The practice putting game of claim 3 wherein said base layer comprises a closely woven synthetic material.

10. The practice putting game according to claim 3 wherein said upright group of fibers are formed of nylon composition.

11. The putting game of claim 1 in which said upright fibers are formed into a plurality of tufts arranged in a plurality of adjacent concentric circles to define said raised ring.

12. The putting game of claim 1 in which said monofilament fibers comprise high resilience synthetic material and said upright fibers comprise relatively low resilience natural textile filaments.

* * * * *